US007793733B2

(12) United States Patent
Stewart

(10) Patent No.: US 7,793,733 B2
(45) Date of Patent: Sep. 14, 2010

(54) VALVE TRIGGER FOR DOWNHOLE TOOLS

(75) Inventor: Alex C. Stewart, Ellon (GB)

(73) Assignee: Baker Hughes Incorporated, Houston, TX (US)

( * ) Notice: Subject to any disclaimer, the term of this patent is extended or adjusted under 35 U.S.C. 154(b) by 42 days.

(21) Appl. No.: 12/229,934

(22) Filed: Aug. 28, 2008

(65) Prior Publication Data

US 2010/0051284 A1 Mar. 4, 2010

(51) Int. Cl.
*E21B 23/06* (2006.01)
*E21B 23/04* (2006.01)

(52) U.S. Cl. ..... 166/386

(58) Field of Classification Search ..... 166/321, 166/386, 373, 264, 185, 184, 141
See application file for complete search history.

(56) References Cited

U.S. PATENT DOCUMENTS

| | | | | |
|---|---|---|---|---|
| 5,238,070 | A * | 8/1993 | Schultz et al. | 166/386 |
| 5,664,629 | A * | 9/1997 | Maitland | 166/373 |
| 6,161,622 | A * | 12/2000 | Robb et al. | 166/386 |
| 6,427,778 | B1 * | 8/2002 | Beall et al. | 166/321 |
| 6,904,975 | B2 * | 6/2005 | Horne et al. | 166/386 |
| 7,552,777 | B2 * | 6/2009 | Murray et al. | 166/381 |
| 7,562,712 | B2 * | 7/2009 | Cho et al. | 166/319 |
| 7,730,954 | B2 * | 6/2010 | Schultz et al. | 166/373 |
| 2003/0094285 | A1 * | 5/2003 | French | 166/380 |
| 2006/0076149 | A1 * | 4/2006 | McCalvin | 166/386 |
| 2007/0125532 | A1 * | 6/2007 | Murray et al. | 166/179 |

OTHER PUBLICATIONS

I.C. Chapman, et al., Wireline Deployed Metal Sealing Bridge Plug System: Operational Learning Curve and Subsequent Redevelopment, SPE 113891, Apr. 1, 2008, pp. 1-13, Society of Petroleum Engineers, The Woodlands, Texas, U.S.A.

* cited by examiner

*Primary Examiner*—William P Neuder
*Assistant Examiner*—Kipp C Wallace
(74) *Attorney, Agent, or Firm*—Greenberg Traurig LLP; Anthony F. Matheny

(57) ABSTRACT

An actuator device for setting a downhole tool comprises a piston disposed in an upper reservoir of the device, the piston comprising two actuation areas upon which pressure acts to move the piston. The upper reservoir is in fluid communication with a lower reservoir through a valve that initially restricts the flow of fluid from the first reservoir to the second reservoir. In setting a downhole tool, fluid pressure initially acts on the first actuation area to slowly move the piston toward a set position. After a predetermined length of movement of the piston, the second actuation area is placed in fluid communication with a pressure such that the valve no longer restricts the flow of fluid through the valve, i.e., the total pressure acting on the piston is increased. This increased pressure rapidly moves the piston to actuate, or set, the downhole tool.

29 Claims, 3 Drawing Sheets

VALVE TRIGGER FOR DOWNHOLE TOOLS

BACKGROUND

1. Field of Invention

The invention is directed to actuator devices for actuating downhole tools and, in particular, to actuator devices comprising a valve that initially moves slowly until a predetermined point at which time the movement of the valve increases to actuate the downhole tool.

2. Description of Art

Some downhole tools need to be retained in an unset position until properly placed in the well. It is only when they are properly located within the well that the downhole tool is set through actuation of either the downhole tool itself or an actuator device that mechanically moves the downhole tool to its set position. One prior technique for actuating downhole tools is creation of a window or passageway within the downhole tool or actuating device exposing the actuating member, e.g., piston, of the downhole tool or actuating device to the wellbore environment, e.g., the hydrostatic wellbore pressure. The hydrostatic pressure then acts upon the actuating member of the downhole tool to move the actuating member and, thus, the downhole tool, to the set position so that the downhole tool is actuated. In this technique, the creation of the window or passageway does not directly actuate the downhole tool.

In other downhole tools or actuating devices, a fluid pumped down the well is used to break shear pins on the downhole tools which release the actuating member so that the downhole tool is moved to its set position. In still other downhole tools or actuating devices, an explosive charge is detonated by a detonator connected to the surface of the well through an electronic line or connected to battery pack located on the downhole tool or actuating device. The force from the combustion of the explosive charge then acts upon the actuating member and the downhole tool is either directly, or indirectly through the actuating device, actuated.

SUMMARY OF INVENTION

In one broad embodiment, the actuating device, or trigger, for downhole tools comprises a differential piston upon which hydrostatic pressure acts to create a force so that a metered volume of fluid flows through a valve during a known time period. The time delay created by the trigger facilitates the operator run a downhole tool, such as a bridge plug, to depth within the well and set the bridge plug without intervention after the predetermined period has elapsed. In one specific embodiment, the trigger is calibrated to actuate the downhole tool after eight hours. It is to be understood, however, that the trigger can be calibrated for any other desired or necessary amount of time so that the downhole tool can be located within the well at the desired depth before the trigger actuates the downhole tool. In another specific embodiment, the trigger is configured so that the resultant internal pressure caused by hydrostatic pressure acting on the differential piston is restricted so that the differential piston slowly moves a certain distance until it reaches a predetermined point. At this predetermined point, the hydrostatic pressure is no longer restricted so that the full force of the hydrostatic pressure can act on the differential piston creating an increased or "surge" pressure that actuates the downhole tool. In one particular embodiment, the surge pressure also ruptures a rupture disk to attempt to prevent the valve from being damaged due to the high surge pressure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
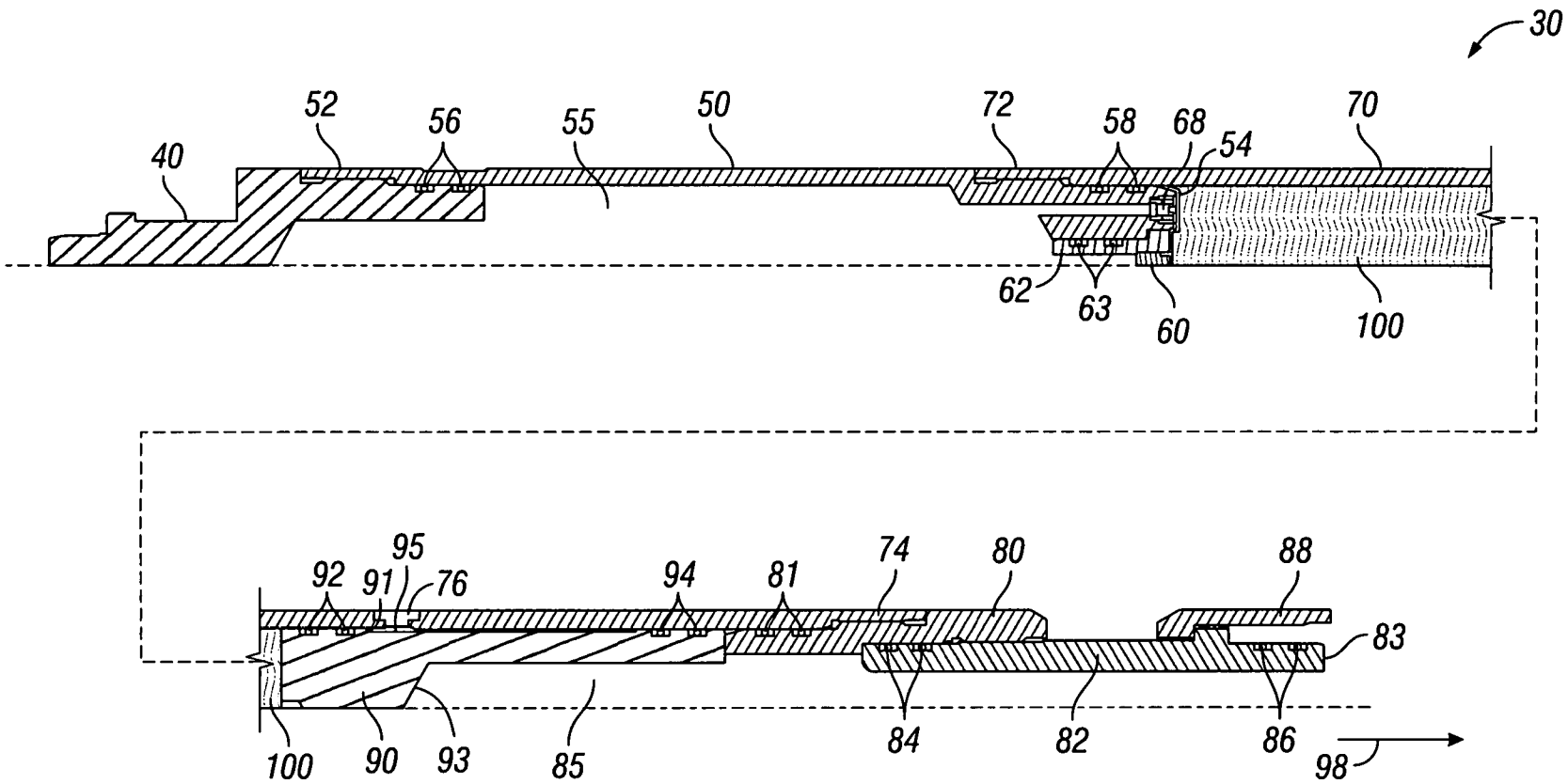
FIG. 1 is a cross-sectional view of one specific embodiment of a valve trigger shown in the run-in or initial position.
Figure 2:
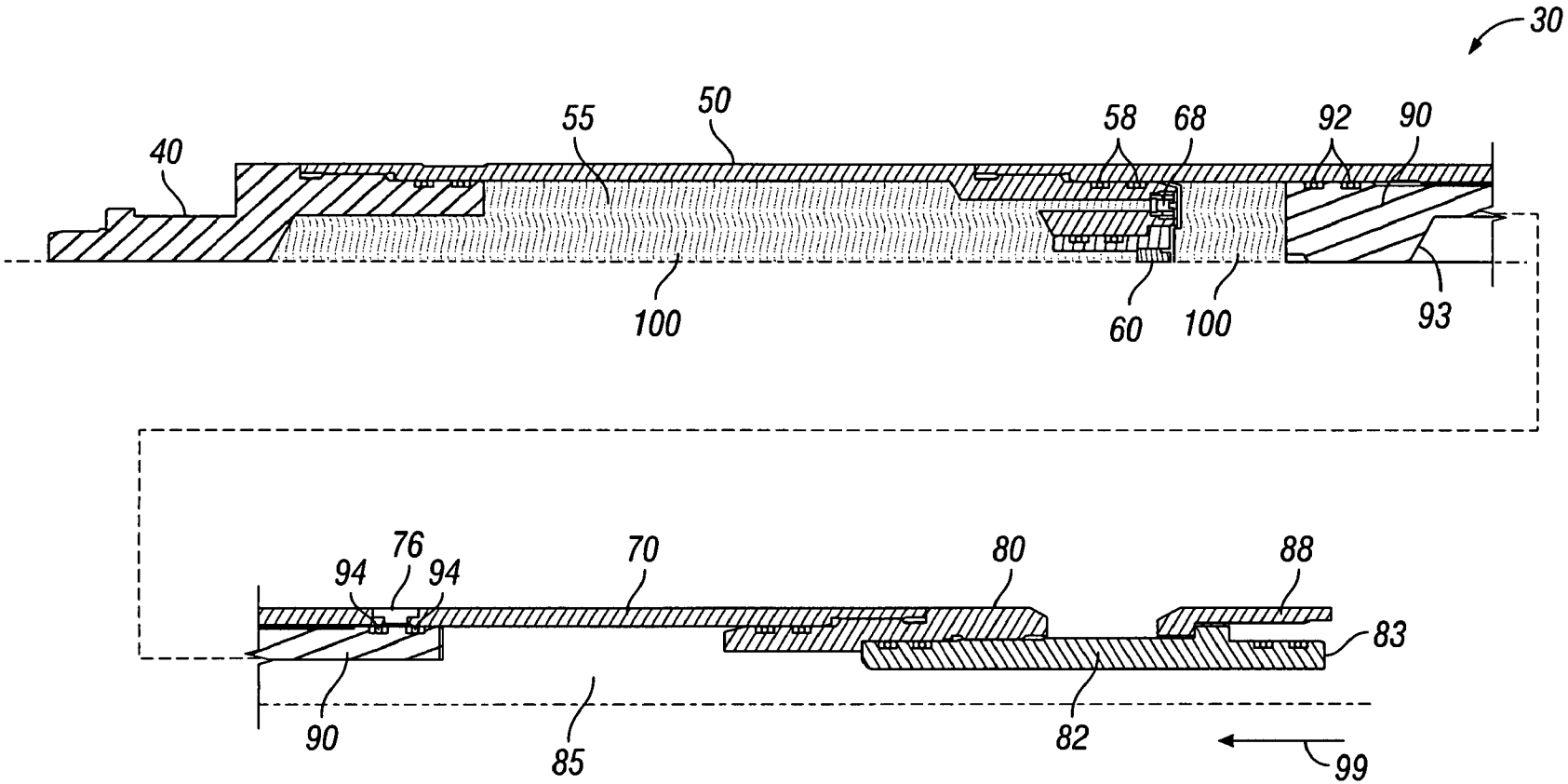
FIG. 2 is a cross-sectional view of the valve trigger of FIG. 1 shown in one of its position as the valve trigger moves from the run-in position to the set position.
Figure 3:
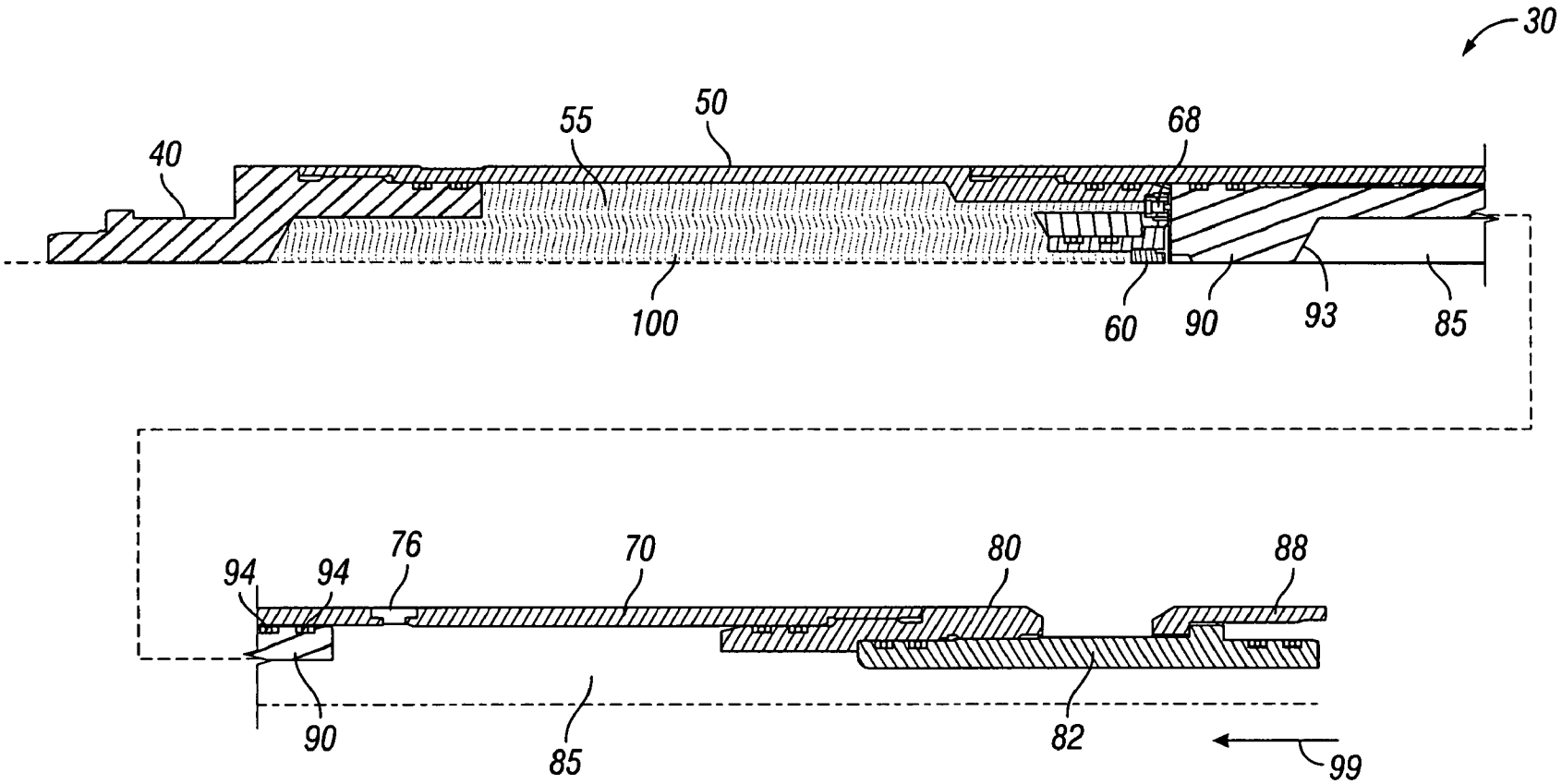
FIG. 3 is a cross-sectional view of the valve trigger of FIG. 1 shown in the position in which a downhole tool is set.

Referring now to FIGS. 1-3, in one specific embodiment, valve trigger 30 comprises top sub or top cap 40, reservoir barrel 50, restrictor 60 which is shown in this embodiment as a check valve, differential piston barrel 70, cross-over sub-assembly 80, feed-thru sub-assembly 82, quick connect 88, and an actuator, e.g., differential piston 90 in this embodiment. Valve trigger 30 is assembled by releasably securing each of the components to one another as shown in FIGS. 1-3 through any known device or method, e.g., threads (not shown). Differential piston 90 is operatively associated with a downhole tool actuator mechanism (not shown) such that movement of piston 90 a predetermined distance causes the actuator mechanism to also move to actuate the downhole tool. Reservoir barrel 50 comprises upper end 52 and lower end 54. Seals 56 facilitate formation of a leak resistant connection between upper end 52 of reservoir barrel 50 and top cap 40. Seals 58 facilitate formation of a leak resistant connection between lower end 54 of reservoir barrel 50 and differential piston barrel 70. Lower end 54 comprises valve as restrictor 60 disposed in restrictor housing 62 which is releasably secured to lower end 54 through any connection device or method known to persons skilled in the art, e.g., threads (not shown). Seals 63 facilitate formation of a leak resistant connection between restrictor housing 62 and reservoir barrel 50.

After reservoir barrel 50 is secured to top cap 40, upper reservoir 55 is established.

Differential piston barrel 70 comprises upper end 72, lower end 74, and port 76 disposed through the wall of piston barrel 70. Upper end 72 is releasably secured to lower end 54 of reservoir barrel 50 and lower end 74 is releasably secured to cross-over sub 80. Seals 81 on cross-over sub 80 facilitate formation of a leak resistant connection between lower end 74 of differential piston barrel 70 and cross-over sub 80.

Feed-thru sub 82 is releasably secured to cross-over sub 80 with seals 84 facilitating formation of a leak resistant connection between feed-thru sub 82 and cross-over sub 80. Lower end 83 of feed-thru sub 82 defines lower reservoir 85. As discussed in greater detail below, lower end 83 is opened so that fluid communication is established between lower reservoir 85 and a chamber of a downhole setting tool assembly (not shown) or a downhole tool (also not shown), such as a hydrostatic setting or hydrostatic inflatable packer or other tool.

Quick connect 88 is operatively associated with the outer wall surface of feed-thru sub 82 for securing valve trigger 30 to the downhole tool string (not shown). Quick connect 88 can be any such connection mechanism known in the art. Feed-thru sub 82 can comprise seals 86 to facilitate formation of a leak resistant connection between feed-thru sub 82 and the downhole tool string.

Differential piston 90 is slidably disposed along the inner wall surface of piston barrel 70 within lower reservoir 85 of piston barrel 70. Piston 90 comprises upper seals 92 and lower seals 94 to facilitate a leak resistant engagement with the inner wall surface of piston barrel 70. In the run-in position (FIG. 1), piston 90 is initially disposed within lower reservoir 85 so that port 76 is disposed between upper and lower seals 92, 94.

Piston 90 further comprises first actuation area 91 and second actuation area 93. As shown in FIG. 1, first actuation area 91 is defined by recess 95 disposed in an outer wall surface of differential piston 90. In the embodiment shown in FIGS. 1-3, first actuation area 91 is smaller than second actuation area 93. Initially, first actuation area 91 is in fluid communication with port 76, but second actuation area 93 is not in fluid communication with port 76. However, as discussed in greater detail below, after differential piston 90 is moved a predetermined distance within differential barrel 70, second actuation area 93 is placed in fluid communication with port 76.

Downward movement of piston 90 in the direction of arrow 98 is restricted by the upper end of cross-over sub 80. Further, as mentioned above, piston 90 is operatively associated with a downhole tool such that movement of piston 90 a predetermined distance facilitates communication of hydrostatic pressure through port 76, into lower reservoir 85, and into a downhole setting tool assembly (not shown) or downhole tool (also not shown) connected to lower end 83 of sub 82 that is placed in fluid communication with lower reservoir 85 through a port (not shown) in lower end 83.

In embodiments in which valve trigger 30 is connected to a downhole setting tool, the communication of hydrostatic pressure from lower reservoir 85 into the downhole setting tool assembly causes the actuation of the downhole setting tool assembly, e.g., by activation of one or more pistons or other actuator devices within the downhole setting tool assembly, that then in turn actuates the downhole tool. The downhole setting tool assembly may be any such device known in the art. For example, the downhole setting tool assembly may be a hydrostatic setting pulling tool which is an arrangement of pistons and barrels used to generate a linear force from applied pressure.

In operation, valve trigger 30 is placed within a downhole tool string (not shown) above a downhole tool (not shown) or downhole setting tool assembly (also not shown) by securing top cap 40 to the downhole tool string and by securing quick connect 88 to the downhole setting tool assembly. The downhole tool string is then run to depth, i.e., located, within a well (not shown) at the location at which the downhole tool is to be actuated. As the downhole tool string is lowered into the well, hydrostatic pressure (not shown) within the well flows through port 76 to act on first actuation area 91 of piston 90 between upper seals 92 and lower seals 94. As shown in FIG. 2, as the hydrostatic pressure increases, piston 90 begins to slowly move upward in the direction of arrow 99. As a result, hydraulic fluid 100 disposed within lower reservoir 85 between lower end 54 of reservoir barrel 50 and the upper end of piston 90 is forced by piston 90 through restrictor 60 into upper reservoir 55.

Due to the small size of first actuation area 91 relative to second actuation area 93, piston 90 moves at a slow pace until lower seals 94 reach port 76. At this point, the seal between lower seals 94 and the inner wall surface of differential piston barrel 70 is broken, such as by lower seals 94 being unseated from lands disposed in the inner wall surface of piston barrel 70, so that hydrostatic pressure is permitted to flow below piston 90 to act on second actuation area 93. The volume below piston 90 within lower reservoir 85 is initially air at atmospheric pressure. The replacement of air at atmospheric pressure with hydrostatic pressure results in an increased upward force of hydrostatic pressure on second actuation area 93, referred sometimes herein as the "surge" pressure, causing piston 90 to move rapidly upward in the direction of arrow 99 until all, or most, of hydraulic fluid 100 is forced out of lower reservoir 85 and piston 90 engages lower end 54 of reservoir barrel 50 (FIG. 3). This rapid movement of piston 90 facilitates actuation of the downhole tool through the ingress of hydrostatic pressure into lower reservoir 85 which then flows into the downhole tool or, in certain embodiments, into a downhole setting tool assembly, releasably secured to lower end 83 of sub 82. As a result, the downhole tool is actuated.

As will be understood by persons skilled in the art, the size or area of first actuation area 91 of piston 90 will determine how fast piston moves before lower seals 94 are unseated such that hydrostatic fluid can act on second actuation area 93. Persons skilled in the art can easily determine the desired or necessary size of first actuation area 91 so that trigger valve 30 actuates the downhole tool at the desired depth and corresponding hydrostatic pressure.

As also will be understood by persons skilled in the art, the rapid movement of piston 40 when the hydrostatic pressure is allowed to act on second actuation area 93 causes forceful movement of hydraulic fluid 100 through restrictor 60 that may, in certain circumstances, cause restrictor 60 to be damaged and, thus, unusable in subsequent uses of trigger valve 30. To decrease the likelihood that restrictor 60 will be damaged, lower end 54 of reservoir barrel 50 can include rupture disk 68. Rupture disks are known in the art. Generally, rupture disk 68 restricts fluid flow up to a maximum predetermined or pre-set pressure. When the pressure acting on rupture disk 68 meets or exceeds this predetermined pressure, it breaks allowing fluid to flow through rupture disk 68 which also facilitates rapid movement of piston 90. In one particular embodiment, rupture disk 68 is designed to break at a pressure below the maximum pressure rating of restrictor 60 so that fluid from lower reservoir 85 flows into upper reservoir 55 through restrictor 60 as well as the opening created by rupture disk 68 breaking.

It is to be understood that the invention is not limited to the exact details of construction, operation, exact materials, or embodiments shown and described, as modifications and equivalents will be apparent to one skilled in the art. For example, the area on which hydrostatic pressure acts on the piston between the upper and lower seals can be modified so that the rate of movement of the piston can be increased or decreased depending on the depth at which the downhole tool is to be actuated. Also, the volume of oil and length of piston may be modified to further modify the rate of movement of the piston until the port is no longer blocked and hydrostatic pressure can enter the lower reservoir. For example, depending on the temperature and pressure in the well, the volume of oil may be increased or decreases so that as temperature increases, and the oil expands, excessive pressure will not build up above piston 90.

Additionally, the use of the terms "upper" and "lower" are only for illustration purposes with respect to the embodiments shown in FIGS. 1-3. It is to be understood that the entire valve trigger can be inverted such that the "upper" seals are below the "lower" seals and "upper" ends can be below the "lower" ends when the valve triggers are run-in the wells. Further, the pressures acting on the two actuation areas are not required to be hydrostatic wellbore pressure. Instead, pressure sources such as one or more pressure lines in fluid communication with the port and a pressure source, e.g., hydraulic or pneumatic pump at the surface of the well, or pressure tanks located on the actuating device itself, may provide the pressures necessary to actuate the actuating device and, thus, the downhole tool. Accordingly, the invention is therefore to be limited only by the scope of the appended claims.

What is claimed is:

1. An actuator device for actuating a downhole tool, the actuator device comprising:

a tubular member having a first reservoir, a second reservoir and a port disposed through a wall of the tubular member thereby placing the first reservoir in fluid communication with an environment outside the tubular member;

a valve disposed within the tubular member between the first reservoir and the second reservoir, the valve at least partially separating the first reservoir from the second reservoir for selectively limiting fluid flow from the first reservoir to the second reservoir; and an actuator disposed in the first reservoir, the actuator comprising a first actuation area, a second actuation area, a run-in position and set position, the run-in position comprising the first actuation area of the actuator being in fluid communication with the port and the second actuation area of the actuator being sealed off from fluid communication with the port, and the set position comprising the second actuation area of the actuator being in fluid communication with the port.

2. The actuator of claim 1, wherein the valve is a check valve.

3. An actuator device for a downhole tool, the actuator device comprising:

a housing comprising an outer wall surface, an inner wall surface and housing bore disposed therein, the housing bore comprising a first reservoir in fluid communication with a second reservoir through a valve; and a differential piston disposed within the first reservoir and in sliding engagement with the inner wall surface of the first reservoir, thereby separating the first reservoir into an upper reservoir and a lower reservoir, the lower reservoir being defined by the inner wall surface of the housing, the piston and the valve, wherein the differential piston comprises a run-in position, a set position, a recess disposed along an outer wall surface of the differential piston, the recess defining a first actuation area initially in fluid communication with a port disposed in the outer wall surface of the housing, an upper seal disposed above the first actuation area, and a lower seal disposed below the recess; and wherein movement of the differential piston by a pressure acting on the first actuation area causes the lower seal to be unseated allowing the pressure to act on a second actuation area of the differential piston causing the differential piston to move to the set position thereby causing the downhole tool to be actuated.

4. The actuator device of claim 3, wherein the first reservoir is disposed below the second reservoir.

5. The actuator device of claim 3, wherein the lower reservoir comprises hydraulic fluid when the differential piston is in the run-in position.

6. The actuator device of claim 3, further comprising a rupture disk disposed between the first reservoir and the second reservoir, the rupture disk rupturing to place the second reservoir in fluid communication with the hydraulic fluid reservoir when the actuator is in the set position.

7. The actuator device of claim 3, wherein the first actuation area comprises a first surface area that is less than a second surface area of the second actuation area.

8. The actuator device of claim 3, wherein the valve is a check valve.

9. A method of actuating a downhole tool, the method comprising the steps of:

(a) providing a downhole tool operatively associated with an actuator device, the actuator device comprising an actuator comprising first and second actuation areas, wherein the first actuation area is initially in fluid communication with a first pressure source when the actuator is in a run-in position and the second actuation area is in fluid communication with a second pressure source when the actuator is in a set position;

(b) lowering the downhole tool and the actuator device into a wellbore;

(c) applying to the first actuation area a first pressure from the first pressure source to begin moving the actuator toward the set position;

(d) moving the actuator a predetermined distance until the second pressure source is in fluid communication with the second actuation area so that a second pressure from the second pressure source is applied to the second actuation area; and (e) actuating the downhole tool by moving the actuator through application of the second pressure to the second actuation area, wherein, during step (e), the first actuation area is blocked from the first pressure source and the second pressure source.

10. The method of claim 9, wherein the first pressure source and the second pressure source comprise the wellbore environment.

11. The method of claim 9, wherein the first actuation area comprises a first surface area, the second actuation area comprises a second surfaced area, the first surface area is less than the second surface area.

12. The method of claim 9, wherein the actuator device further comprises a rupture disk that is ruptured during step (e).

13. The method of claim 9, wherein during steps (c) through (e) fluid is transported through a restrictor disposed between first and second reservoirs of the actuator device.

14. The actuator device for actuating a downhole tool, the actuator device comprising:

a tubular member having a first reservoir, a second reservoir and a port disposed through a wall of the tubular member thereby placing the first reservoir in fluid communication with an environment outside the tubular member;

a fluid flow restrictor disposed between the first reservoir and the second reservoir, the fluid flow restrictor selectively limiting fluid flow from the first reservoir to the second reservoir; and an actuator disposed in the first reservoir, the actuator comprising a first actuation area, a second actuation area, a run-in position and set position, the run-in position comprising the first actuation area of the actuator being in fluid communication with the port and the second actuation area of the actuator being sealed off from fluid communication with the port, and the set position comprising the second actuation area of the actuator being in fluid communication with the port, wherein the actuator comprises a differential piston in sliding engagement with an inner wall surface of the tubular member within the first reservoir, the differential piston comprising a first seal that restricts fluid flow from the port to the second actuation area when the differential piston is in the run-in position, and wherein the first actuation area of the differential piston is at least partially defined by a recess disposed along an outer wall surface of the differential piston and a second seal is disposed below the recess.

15. The actuator device of claim 14, wherein the fluid flow restrictor is a valve.

16. The actuator of claim 15, wherein the valve is a check valve.

17. The actuator device of claim 14, wherein the first reservoir is disposed below the second reservoir.

18. The actuator device of claim 14, further comprising a hydraulic fluid reservoir defined by the inner wall surface of the housing, the piston and the valve.

19. The actuator device of claim 14, further comprising a rupture disk disposed between the first reservoir and the second reservoir, the rupture disk rupturing to place the second reservoir in fluid communication with the hydraulic fluid reservoir when the actuator is in the set position.

20. The actuator device of claim 14, wherein the first actuation area comprises a surface area that is less than a surface area of the second actuation area.

21. The actuator device for actuating a downhole tool, the actuator device comprising:

a tubular member having a first reservoir, a second reservoir and a port disposed through a wall of the tubular member thereby placing the first reservoir in fluid communication with an environment outside the tubular member;

a fluid flow restrictor disposed between the first reservoir and the second reservoir, the fluid flow restrictor selectively limiting fluid flow from the first reservoir to the second reservoir;

an actuator disposed in the first reservoir, the actuator comprising a first actuation area, a second actuation area, a run-in position and set position, the run-in position comprising the first actuation area of the actuator being in fluid communication with the port and the second actuation area of the actuator being sealed off from fluid communication with the port, and the set position comprising the second actuation area of the actuator being in fluid communication with the port; and a rupture disk disposed between the first reservoir and the second reservoir, the rupture disk rupturing to place the second reservoir in fluid communication with the hydraulic fluid reservoir when the actuator is in the set position.

22. The actuator device of claim 21, wherein the actuator comprises a differential piston in sliding engagement with an inner wall surface of the tubular member within the first reservoir.

23. The actuator device of claim 22, wherein the differential piston comprises a first seal that restricts fluid flow from the port to the second actuation area when the differential piston is in the run-in position.

24. The actuator device of claim 23, wherein the first actuation area of the differential piston is at least partially defined by a recess disposed along an outer wall surface of the differential piston and a second seal is disposed below the recess.

25. The actuator device of claim 21, wherein the fluid flow restrictor is a valve.

26. The actuator of claim 25, wherein the valve is a check valve.

27. The actuator device of claim 21, wherein the first reservoir is disposed below the second reservoir.

28. The actuator device of claim 21, further comprising a hydraulic fluid reservoir defined by the inner wall surface of the housing, the piston and the valve.

29. The actuator device of claim 21, wherein the first actuation area comprises a surface area that is less than a surface area of the second actuation area.

* * * * *